US008706509B2

(12) United States Patent
Näslund et al.

(10) Patent No.: US 8,706,509 B2
(45) Date of Patent: Apr. 22, 2014

(54) METHOD AND A DECODER FOR ATTENUATION OF SIGNAL REGIONS RECONSTRUCTED WITH LOW ACCURACY

(75) Inventors: Sebastian Näslund, Upplands Väsby (SE); Volodya Grancharov, Solna (SE); Erik Norvell, Stockholm (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 227 days.

(21) Appl. No.: 13/379,054

(22) PCT Filed: Dec. 15, 2011

(86) PCT No.: PCT/EP2011/072963

§ 371 (c)(1),
(2), (4) Date: Jan. 11, 2012

(87) PCT Pub. No.: WO2012/139668

PCT Pub. Date: Oct. 18, 2012

(65) Prior Publication Data

US 2012/0278085 A1 Nov. 1, 2012

Related U.S. Application Data

(60) Provisional application No. 61/475,711, filed on Apr. 15, 2011.

(51) Int. Cl.
*G10L 19/00* (2013.01)
*G10L 21/00* (2013.01)

(52) U.S. Cl.
USPC ..... 704/500; 704/201; 704/212; 704/222

(58) Field of Classification Search
USPC ..... 704/201, 212, 222, 228, 500
See application file for complete search history.

(56) References Cited

U.S. PATENT DOCUMENTS

| | | | | | |
|---|---|---|---|---|---|
| 4,617,676 | A * | 10/1986 | Jayant et al. | ..... | 704/212 |
| 5,241,227 | A * | 8/1993 | Jung et al. | ..... | 327/553 |
| 5,852,805 | A * | 12/1998 | Hiratsuka et al. | ..... | 704/500 |
| 5,901,234 | A * | 5/1999 | Sonohara et al. | ..... | 381/104 |
| 5,946,651 | A * | 8/1999 | Jarvinen et al. | ..... | 704/223 |
| 7,787,632 | B2 * | 8/2010 | Ojanpera | ..... | 381/23 |
| 8,195,454 | B2 * | 6/2012 | Muesch | ..... | 704/226 |
| 2009/0292536 | A1 * | 11/2009 | Hetherington et al. | ..... | 704/225 |

FOREIGN PATENT DOCUMENTS

| | | | |
|---|---|---|---|
| WO | 0045379 | A2 | 8/2000 |
| WO | 03107328 | A1 | 12/2003 |
| WO | 2009029036 | A1 | 3/2009 |

* cited by examiner

*Primary Examiner* — Shaun Roberts
(74) *Attorney, Agent, or Firm* — Coats & Bennett, P.L.L.C.

(57) ABSTRACT

The embodiments of the present invention improves conventional attenuation schemes by replacing constant attenuation with an adaptive attenuation scheme that allows more aggressive attenuation, without introducing audible change of signal frequency characteristics.

20 Claims, 13 Drawing Sheets

METHOD AND A DECODER FOR ATTENUATION OF SIGNAL REGIONS RECONSTRUCTED WITH LOW ACCURACY

TECHNICAL FIELD

The embodiments of the present invention relate to a decoder, an encoder for audio signals, and methods thereof. The audio signals may comprise speech in various conditions, music and mixed speech and music content. In particular, the embodiments relate to attenuation of spectral regions which are poorly reconstructed. This may for instance apply to regions which are coded with a low number of bits or with no bits assigned.

BACKGROUND

Traditionally mobile networks are designed to handle speech signals at low bitrates. This has been realised by using designated speech codecs which show good performance for speech signals at low bit rates, but has poor performance for music and mixed content. There is an increasing demand that the networks should also handle these signals, for e.g. music-on-hold and ringback tones. Mobile internet applications further drive the need for low bitrate audio coding for streaming applications. Audio codecs normally operate using a higher bitrate than the speech codecs. When constraining the bit budget for the audio codec, certain spectral regions of the signal may be coded with a low number of bits, and the desired target quality of the reconstructed signal can therefore not be guaranteed. The spectral regions refer to frequency domain regions, e.g., certain subbands of the frequency transformed signal block. For simplicity "spectral regions" will be used throughout the specification with the meaning of "part of short-time signal spectra".

Moreover, at low- and moderate bitrates there will be spectral regions with no bits assigned. Such spectral regions have to be reconstructed at the decoder, by reusing information from the available coded spectral regions (e.g., noise-fill or bandwidth extension). In all these cases some attenuation of energy of low accuracy reconstructed regions is desirable to avoid loud signal distortions.

The signal regions coded with either sufficient number of bits or with no bits assigned will be reconstructed with low accuracy and accordingly it is desired to attenuate these spectral regions. Here, the insufficient number of bits is defined as a number of bits which are too low to be able to represent the spectral region with perceptually plausible quality. Note that this number will be dependent on the sensitivity of the audio perception for that region as well as the complexity of the signal region at hand.

However, attenuation of low-accuracy coded spectral regions is not a trivial problem. On one hand, strong attenuation is desired to mask unwanted distortion. On the other hand, such attenuation might be perceived by listeners as loudness loss in the reconstructed signal, change of frequency characteristics, or change in signal dynamics e.g., over time coding algorithm can select different signal regions to noise-fill. For these reasons conventional audio coding systems apply very conservative, i.e. limited, attenuation, which achieves on average certain balance between different types of the above listed distortions.

SUMMARY

The embodiments of the present invention improves conventional attenuation schemes by replacing constant attenuation with an adaptive attenuation scheme that allows more aggressive attenuation, without introducing audible change of signal frequency characteristics.

According to a first aspect a method for a decoder for determining an attenuation to be applied to an audio signal is provided. In the method, spectral regions to be attenuated are identified, subsequent identified spectral regions are grouped to form a continuous spectral region, a width of the continuous spectral region is determined, and an attenuation of the continuous spectral region adaptive to the width is applied such that an increased width decreases the attenuation of the continuous spectral region.

According to a second aspect, an attenuation controller of a decoder for determining an attenuation to be applied to an audio signal is provided. The attenuation controller comprises an identifier unit configured to identify spectral regions to be attenuated, a grouping unit configured to group subsequent identified spectral regions to form a continuous spectral region, and a determination unit configured to determine a width of the continuous spectral region. Further, an application unit is provided, wherein the application unit is configured to apply an attenuation of the continuous spectral region adaptive to the width such that an increased width decreases the attenuation of the continuous spectral region.

According to a third aspect, a mobile terminal is provided. The mobile terminal comprises a decoder with an attenuation controller. The attenuation controller comprises an identifier unit configured to identify spectral regions to be attenuated, a grouping unit configured to group subsequent identified spectral regions to form a continuous spectral region, and a determination unit configured to determine a width of the continuous spectral region. Further, an application unit is provided, wherein the application unit is configured to apply an attenuation of the continuous spectral region adaptive to the width such that an increased width decreases the attenuation of the continuous spectral region.

According to a fourth aspect, a network node is provided. The network node comprises a decoder with an attenuation controller. The attenuation controller comprises an identifier unit configured to identify spectral regions to be attenuated, a grouping unit configured to group subsequent identified spectral regions to form a continuous spectral region, and a determination unit configured to determine a width of the continuous spectral region. Further, an application unit is provided, wherein the application unit is configured to apply an attenuation of the continuous spectral region adaptive to the width such that an increased width decreases the attenuation of the continuous spectral region.

An advantage with embodiments of the present invention is that the proposed adaptive attenuation allows for a significant reduction of audible noise in the reconstructed audio signal compared to conventional systems, which have restrictive constant attenuation.

DETAILED DESCRIPTION

The decoder according to embodiments of the present invention can be used in an audio codec, audio decoder, which can be used in end user devices such as mobile devices (e.g. a mobile phone) or stationary PCs, or in network nodes where decoding occurs. The solution of the embodiments of the invention relates to an adaptive attenuation that allows more aggressive attenuation, without introducing audible change of signal frequency characteristics. That is achieved in the attenuation controller in the decoder, as illustrated in a flowchart of FIG. 2.

Figure 2:
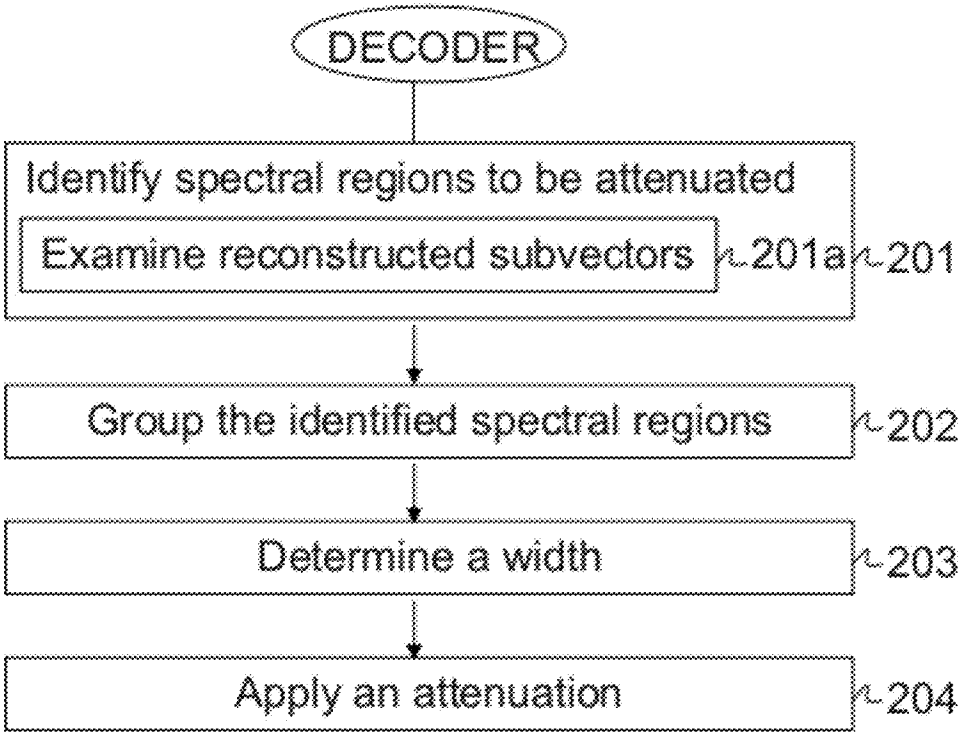
FIG. 2 is a flowchart of a method according to an embodiment of the present invention.

The flowchart of FIG. 2 shows a method in a decoder according to one embodiment. First, spectral regions to be attenuated are identified 201. This step may involve an examination of the reconstructed subvectors 201*a*. Subsequent identified spectral regions are grouped 202 to form a continuous spectral region and a width of the continuous spectral region is determined 203. Then, an attenuation of the continuous spectral region is applied 204, wherein the attenuation is adaptive to the width such that an increased width decreases the attenuation of the continuous spectral region.

An attenuation controller according to embodiments can be implemented in an audio decoder in a mobile terminal or in a network node. The audio decoder can be used in a real-time communication scenario targeting primarily speech or in a streaming scenario targeting primarily music.

Figure 1:
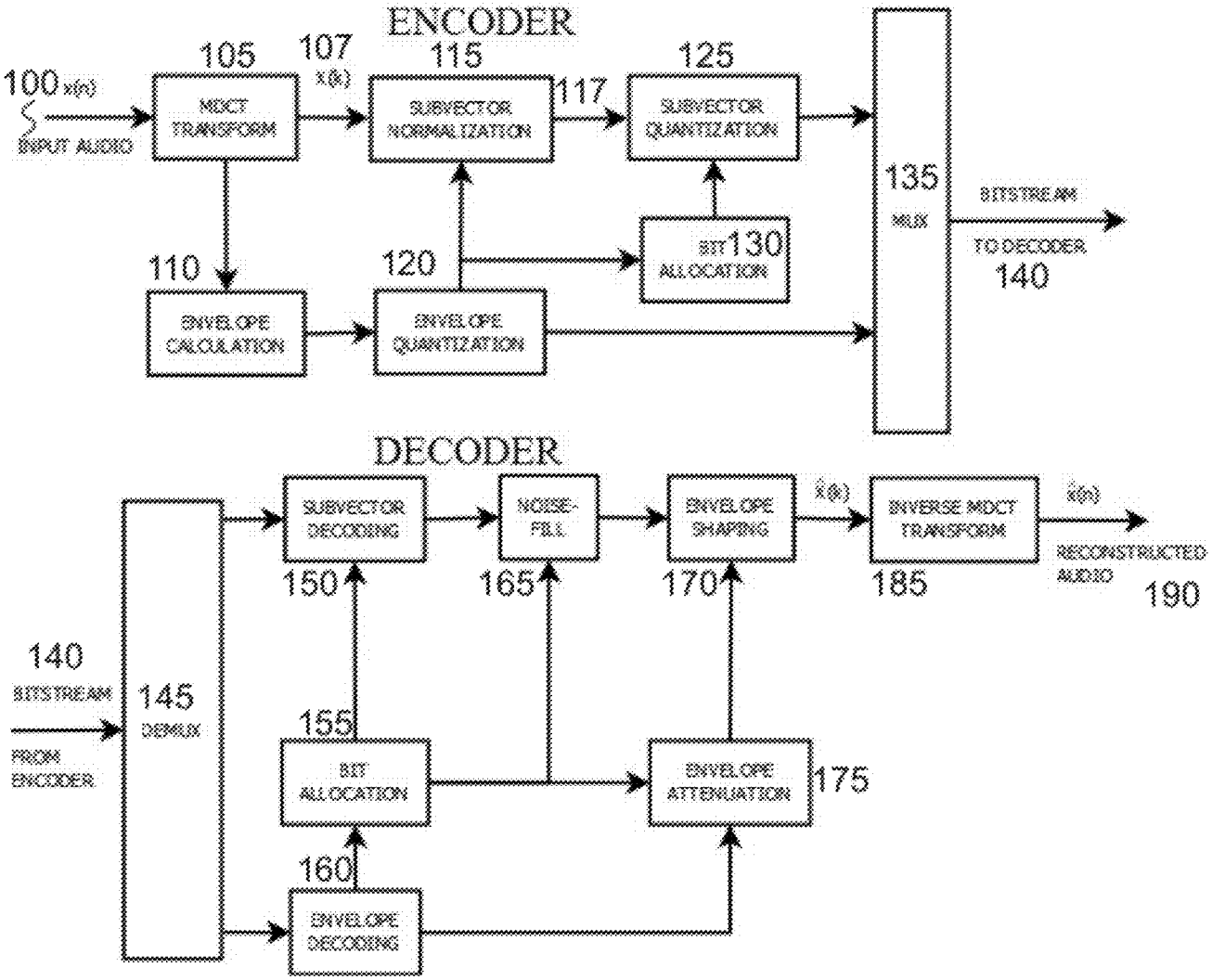
FIG. 1 illustrates schematically an overview of a MDCT transform based encoder and a decoder system.

In one embodiment, the audio codec where the attenuation controller is being implemented is a transform domain audio codec e.g. employing a pulse-based vector quantization scheme. In this exemplary embodiment, a Factorial Pulse Coding (FTC) type quantizer is used but it is understood by a person skilled in the art that any vector quantizing scheme may be used. A schematic overview of such an audio codec is shown in FIG. 1 and a short description of the steps involved is given below.

A short audio segment (20-40 ms), denoted input audio, 100 is transformed to the frequency domain by a Modified Discrete Cosine Transform (MDCT) 105

The MDCT vector X(k) 107 obtained by the MDCT 105 is split into multiple bands, i.e. subvectors. Note that any other suitable frequency transform may be used instead of MDCT, such as DFT or DCT.

The energy in each band is calculated in an envelope calculator 110, which gives an approximation of the spectrum envelope.

The spectrum envelope is quantized by an envelope quantizer 120, and the quantization indices are sent to the bitstream multiplexer in order to be stored or transmitted to a decoder.

A residual vector 117 is obtained by scaling of the MDCT vectors using the inverse of the quantized envelope gains, e.g., the residual in each band is scaled to have unit Root-Mean-Square (RMS) Energy.

Bits for a quantizer performing a quantization of different residual subvectors 125 are assigned by a bit allocator 130 based on quantized envelope energies. Due to a limited bit-budget, some of the subvectors receive no bits.

Based on the number of available bits, the residual subvectors are quantized, and the quantization indices are transmitted to the decoder. Residual quantization is performed with a Factorial Pulse Coding (FPC) scheme. A multiplexer 135 multiplexes the quantization indices of the envelope and the subvector into a bitstream 140 which may be stored or transmitted to the decoder.

It should be noted that residual subvectors with no bits assigned are not coded, but noise-filled at the decoder. This can be achieved by creating a virtual codebook from coded subvectors or any other noise-fill algorithm. The noise-fill creates content in the non-coded subvectors.

With further reference to FIG. 1, the decoder receives the bitstream 140 from the encoder at a demultiplexer 145. The quantized envelope gains are reconstructed by the envelope decoder 160. The quantized envelope gains are used by the bit allocator 155 which produces a bit allocation which is used by the subvector decoder 150 to produce the decoded residual subvectors. The sequence of the decoded residual subvectors forms a normalized spectrum. Due to the restricted bit budget, some of the subvectors will not be represented and will yield zeroes or holes in the spectrum. These spectral holes are filled by a noise filling algorithm 165. The noise filling algorithm may also include a BWE algorithm, which may reconstruct the spectrum above the last encoded band. Using the bit allocation, a fixed envelope attenuation is determined 175. The quantized envelope gains are modified using the determined attenuation and an MDCT spectrum is reconstructed by scaling the decoded residual subvectors using these gains 170. Finally, a reconstructed audio frame 190 is produced by inverse MDCT 185.

The embodiments of the presented invention are related to the envelope attenuation described above, previous step in the list above, where additional weighting of the envelope gains is added to control the energy of subvectors quantized with low precision, that is subvectors coded with a low number, or non-coded noise-filled subvectors. The subvectors coded with a low number of bits imply that the number of bits is insufficient to achieve a desirable accuracy. Thus, the insufficient number of bits is defined as a number of bits which are too low to be able to represent the spectral region with perceptually plausible quality. Note that this number will be dependent on the sensitivity of the audio perception for that region as well as the complexity of the signal region at hand.

Figure 3A:
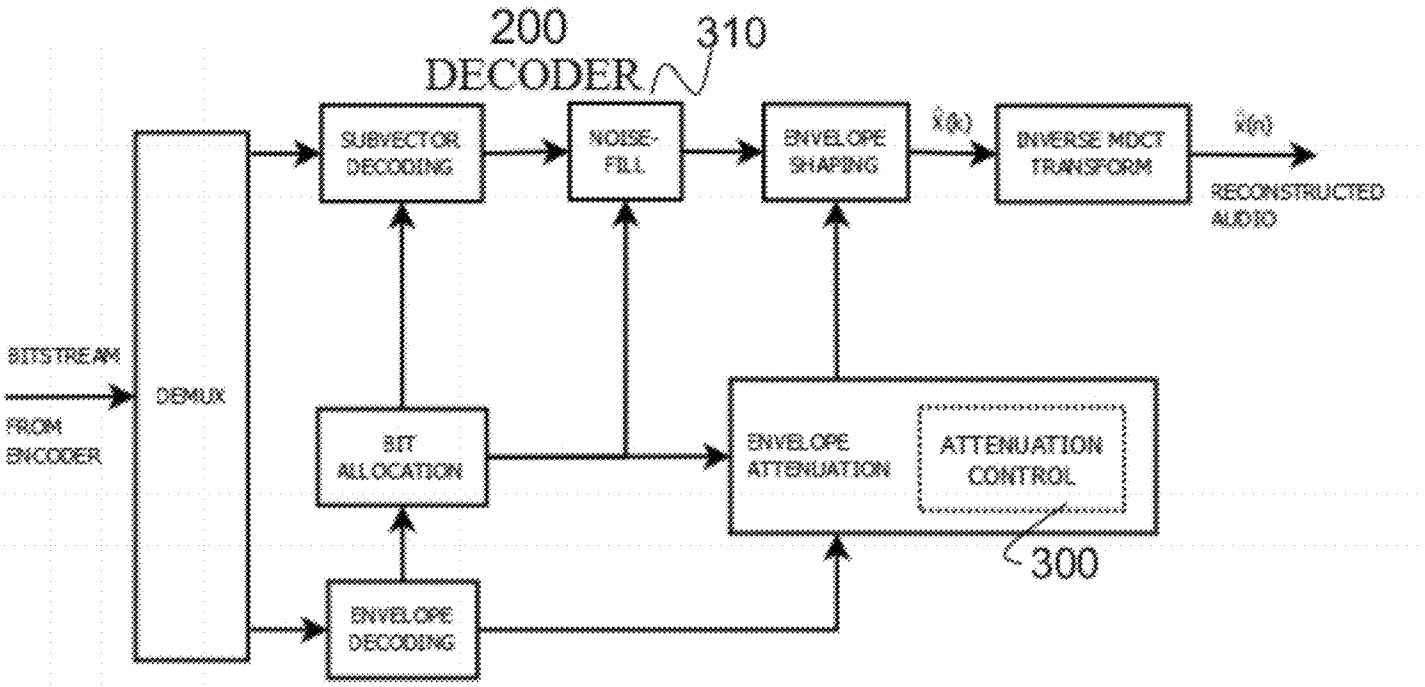
FIGS. 3*a* and 3*b* illustrate overviews of a decoder containing an attenuation control according to embodiments of the present invention.

An overview of a decoder in such a scheme with the algorithm according to embodiments is shown in FIG. 3*a*. The decoder of FIG. 3*a* corresponds to the decoder of FIG. 1 with the addition of an attenuation controller 300 according to embodiments of the present invention. The attenuation controller 300 controls the adaptive attenuation according to embodiments of the invention.

Accordingly, the attenuation controller is configured to identify spectral, regions to be attenuated, to group the identified spectral regions to form a continuous spectral region, to determine a width of the continuous spectral region, and to apply an attenuation of the continuous spectral region adaptive to the width such that an increased width decreases the attenuation of the continuous spectral region.

The low precision spectral regions to be attenuated are according to the embodiments either coded with a low number of bits or with no bits assigned. The step of identifying low precision spectral regions may also comprise an analysis of the reconstructed subvectors.

With reference again to FIG. 2 which is a flowchart of a method according to an embodiment of the present invention, the first step 201 is to examine 201*a* the reconstructed subvectors to identify the spectral regions of the decoded frequency domain residual that are represented with low precision. According to one embodiment, the spectral region is said to be represented with low precision when the assigned number of bits for the said reconstructed subvector is below a predetermined threshold.

According to another embodiment, a pulse coding scheme is employed to encode the spectral subvectors and a spectral region is said to be represented with low precision if it consists of one or more consecutive subvectors where the number of pulses P(b) is below a predetermined threshold.

Figure 3B:
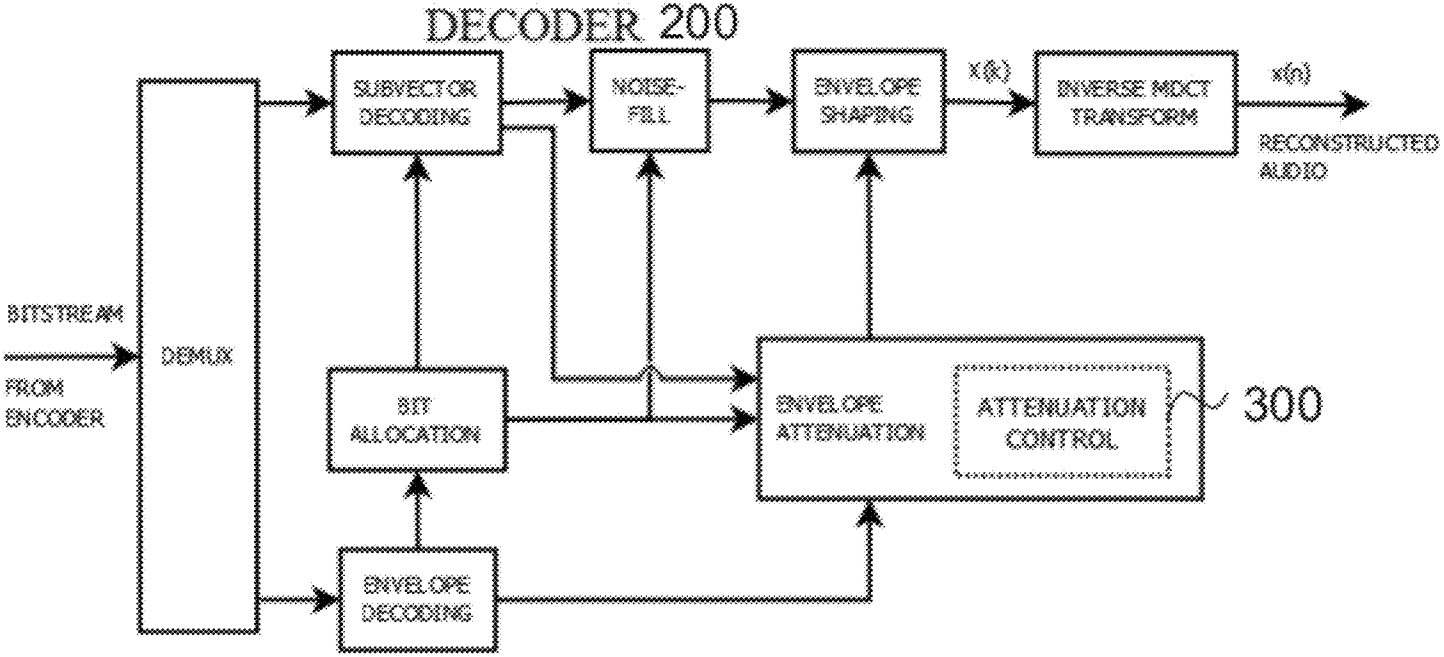

Hence, it is determined if the spectral subvectors comprise of one or more consecutive subvectors where the number of pulses P(b) used to quantize the subvector fulfills equation 1.

$$P(b)<\Theta,\ b=1, 2 \ldots N_b \tag{1}$$

where $N_b$ is the number of subvectors and $\Theta$ is a threshold with preferred value of $\Theta=10$. It should be noted that the number of pulses can be converted to a number of bits. Further, more elaborate methods may be applied to identify the low precision regions, e.g. by using the bitrate in conjunction with analysis of the synthesized shape vector. Such a setup is illustrated in FIG. 3*b*, where the synthesized shape vector is input to the envelope attenuator. The analysis of the synthesized shape may e.g. involve measuring the peakiness of the synthesized shape, as a peaky synthesis for higher rates may indicate a peaky input signal and hence better input/synthesis coherence. The estimated accuracy of the decoded subvector may be used to identify the corresponding band as a low resolution band and decide a suitable attenuation.

Subvectors that received zero bits in the bit allocation and are noise-filled may also be included in this category.

Returning to FIG. 2, for each identified low precision spectral region, the identified spectral regions are grouped 202 and the width of the grouped spectral region is determined 203 by e.g. counting the number of subvectors in the grouped region.

To obtain the best possible audio quality, it is desirable to attenuate the low precision regions of the spectrum. According to embodiments, the attenuation 204 is dependent on the width of low precision spectral region. Hence the attenuation should be decreased with the width. That implies that a narrow region allows a larger attenuation than a wider region.

As an example, the attenuation can be obtained in two steps. First, an initial attenuation factor A(b) is decided per subvector b. For noise filled subvectors, the attenuation factor is decided based on the number of consecutive noise filling subvectors. For the low precision coded vectors an accuracy function may be used to define the initial attenuation. When the low precision regions are identified, the attenuation level for each region is estimated using the bandwidth of the low precision region. The attenuation factors are adjusted to form A'(b) which take into consideration the low precision region bandwidth.

Figure 4:
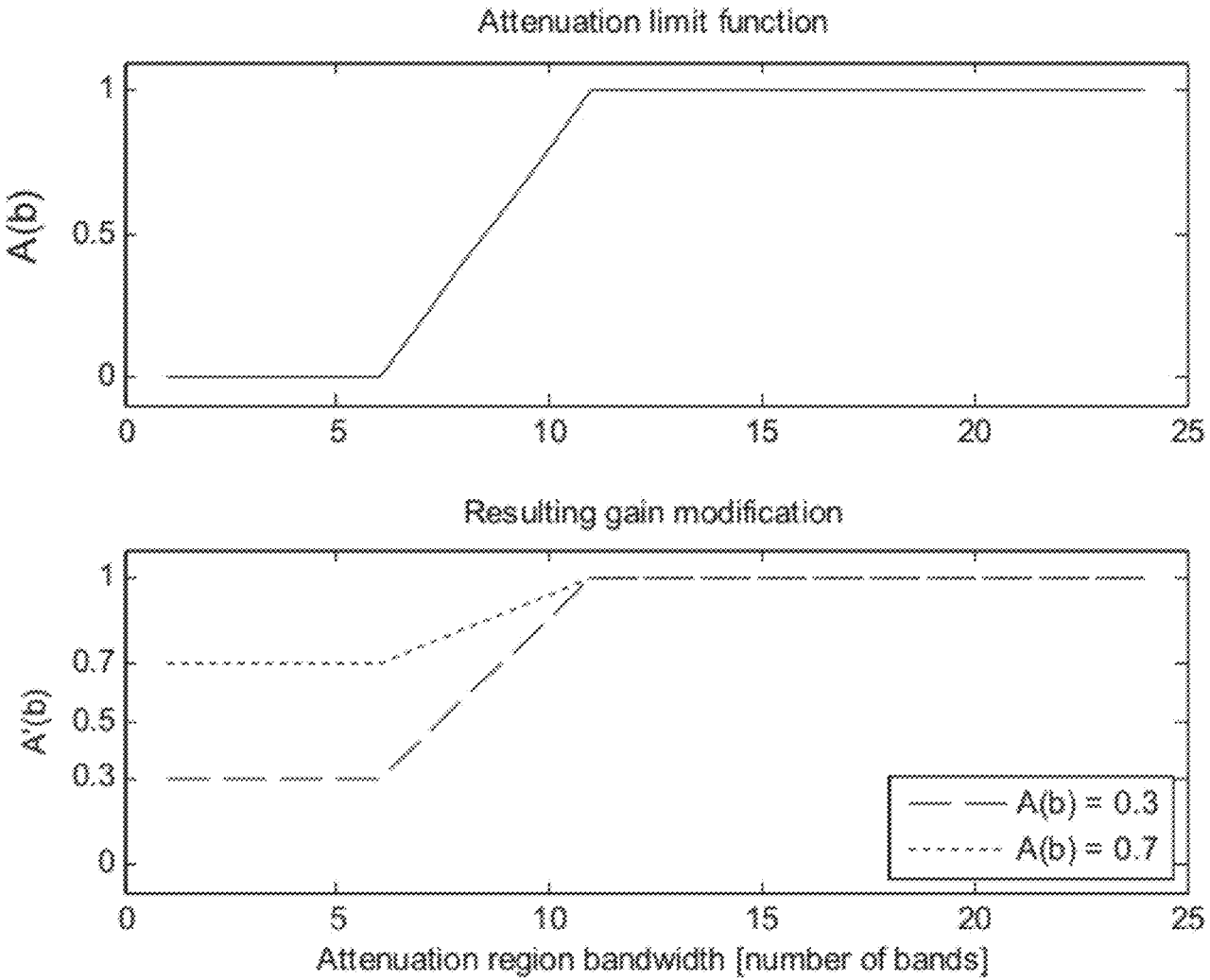
FIG. 4 shows an attenuation limit function which can be used by the embodiments and the resulting gain modification when applying the attenuation limiting function.

An example attenuation limiting function A(b) depending on the bandwidth b of the low precision region is shown in FIG. 4. The resulting gain modification A'(b) also shown in FIG. 4 can be described using equation 2, $$A'(b)=\alpha(w)+(1-\alpha(w))A(b) \tag{2}$$

where $\alpha(w)$ is defined in equation 3, $$\alpha(w)=\begin{cases}0, & w<C\\ 1, & (w-C)/T>1\\ (w-C)/T, & \text{otherwise}\end{cases} \tag{3}$$

where w denotes the bandwidth in number of subvectors of the low precision region, and C and T are constants which control the adjustment function a(w). In this example, it was found that suitable values were C=6 and T=5.

Figure 5A:
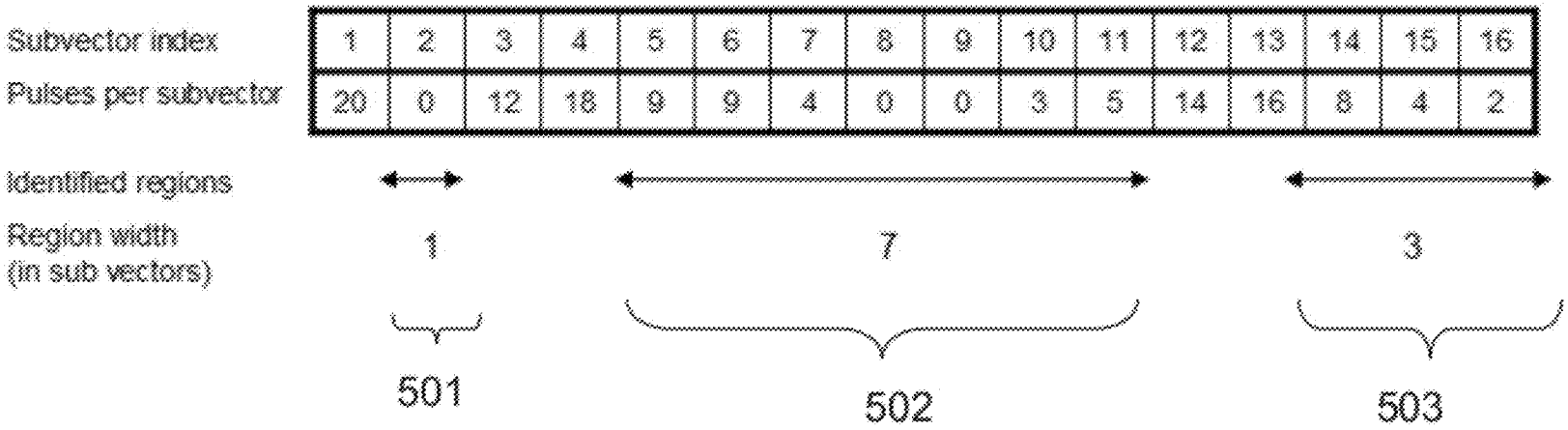
FIG. 5*a* shows an example of 1.6 subvectors with pulse allocation, wherein low precisions regions are identified and the width of the respective region is determined according to embodiments of the present invention.
Figure 5B:
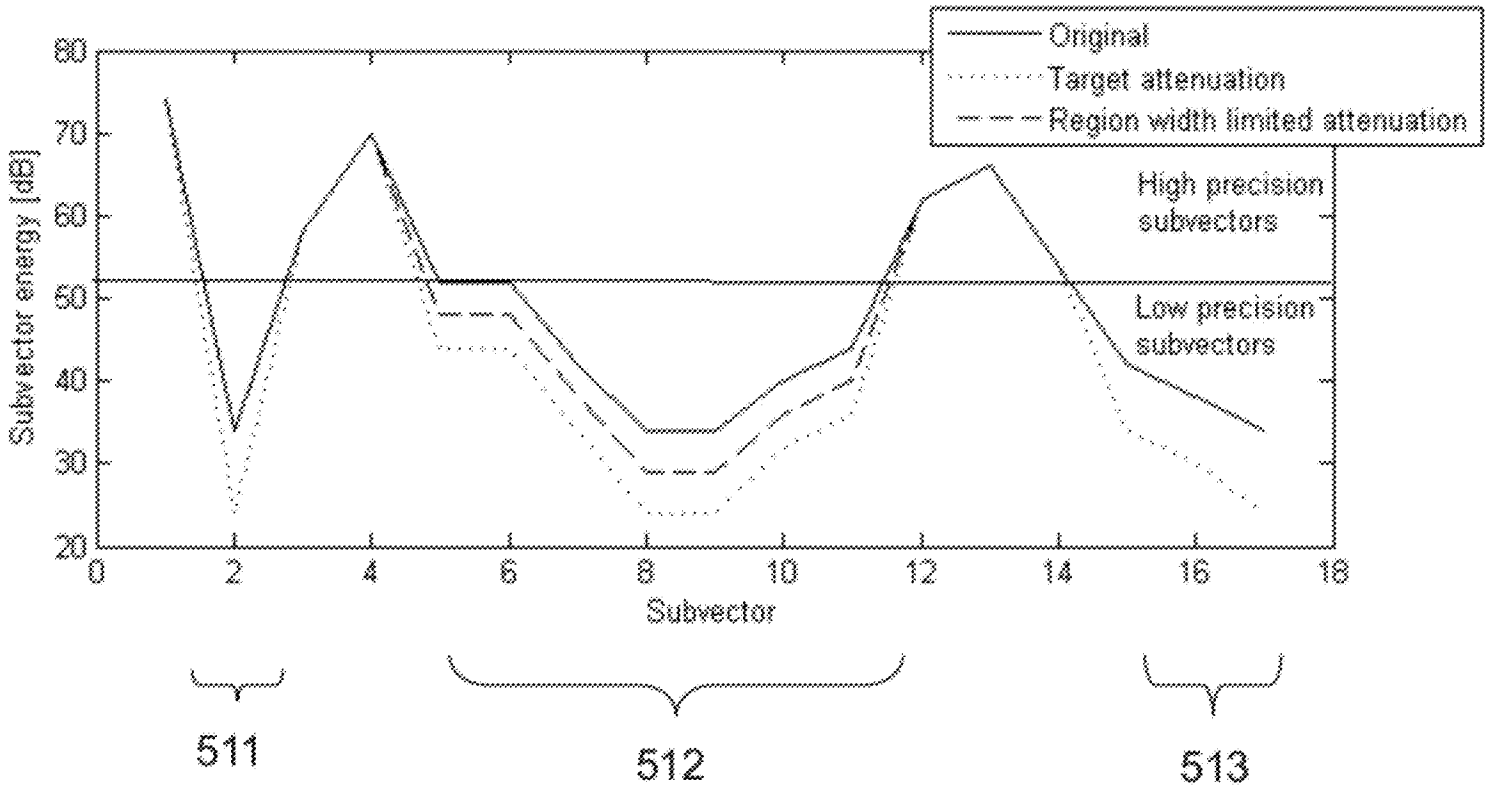
FIG. 5*b* shows the impact of the attenuation when the adaptive attenuation is applied according to embodiments of the present invention.

FIG. 5*a* shows an example of the first 16 subvectors and the number of pulses used to quantize each subvector together with the low precision regions identified by the algorithm and the region widths in subvectors. Subsequent low precision regions are grouped to form a continuous spectral region 501; 502; 503 and the width of the continuous spectral region is determined. The width of each region is used for determining the attenuation to be applied. FIG. 5*b* shows the impact of the algorithm on the corresponding subvector energies. One can see how the algorithm limits the attenuation in the region 512 that has a width of 7 subvectors while it allows target attenuation of the regions 511 and 513 that are 1 and 3 subvectors wide respectively. Hence, the attenuation decreased with the width of the low precision spectral region. Since the bands are non-uniform with increasing bandwidth for higher frequencies and the width is defined in number of bands, the scheme will have an implicit frequency dependency. Since the bandwidths correspond to the perceptual frequency resolution, the perceived attenuation should be roughly constant across the spectrum. However, one could also consider making this frequency dependency explicit. One possible implementation is to modify the adjustment function $$\alpha(w, f)=\begin{cases}0, & w<C\\ 1, & \left(w\frac{\beta}{f}-C\right)/T>1\\ \left(w\frac{\beta}{f}-C\right)/T, & \text{otherwise}\end{cases} \tag{4}$$

where f denotes the frequency bin of the spectrum and $\beta$ is a tuning parameter. One possible value for $\beta$ is L/4, where L is the number of coefficients in the MDCT spectrum. The equation (4) will allow more attenuation for higher frequencies, similar to what is already obtained in this embodiment. One could also make the inverse relation w.r.t. frequency like so $$\alpha(w, f)=\begin{cases}0, & w<C\\ 1, & (w\gamma f-C)/T>1\\ (w\gamma f-C)/T, & \text{otherwise}\end{cases} \tag{5}$$

where $\gamma$ denotes another tuning parameter. In this case the attenuation will be restricted for higher frequencies. This may be desirable if it is found that there is less benefit of attenuation for higher frequencies.

In a further embodiment, the concept described above can be restricted to the noise-filled regions only, if due to specifics of the quantizer; sub-bands with low number of assigned bits are treated separately.

In an alternative embodiment, the concept described in conjunction with the first embodiment can operate without noise-filled bands, e.g., if the codec operates at high-bitrate and noise-filled bands do not exist.

In a further embodiment, the reconstructed spectrum also includes a region which is reconstructed using a bandwidth extension (BWE) algorithm. The concept of adaptive attenuation of low accuracy reconstructed signal regions can be used in combination with a BWE module. Modern BWE algorithms apply certain attenuation on reconstructed spectral regions that are detected to be very different from the corresponding regions in the target signal. Such attenuation can be also made adaptive according to the concept described above. BWE algorithm may be an integral part of the noise-filling unit 310 as disclosed in FIG. 3*a*. The BWE algorithm modified according to the embodiments can be part both time domain codecs or transform domain codecs.

Figure 6A:
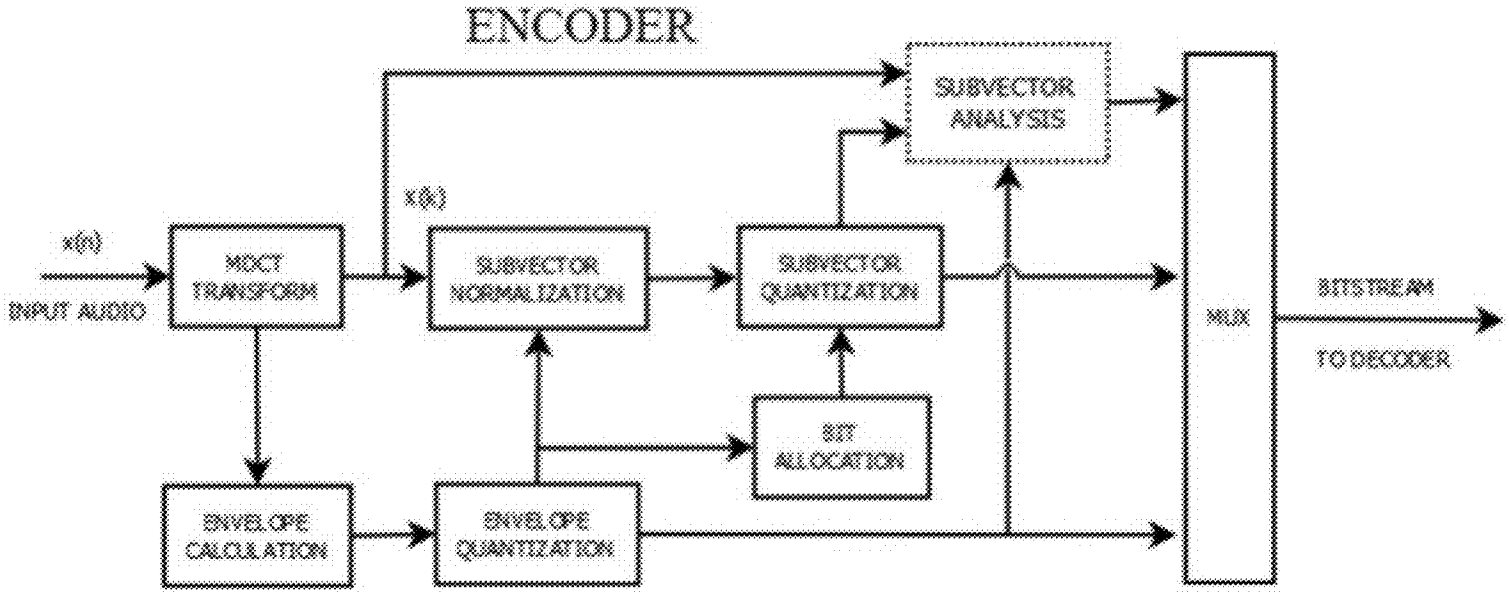
FIG. 6*a* illustrates schematically an overview of an encoder containing a subvector analysis unit, wherein the result of the subvector analysis unit is used by the decoder according to embodiments of the present invention.
Figure 6B:
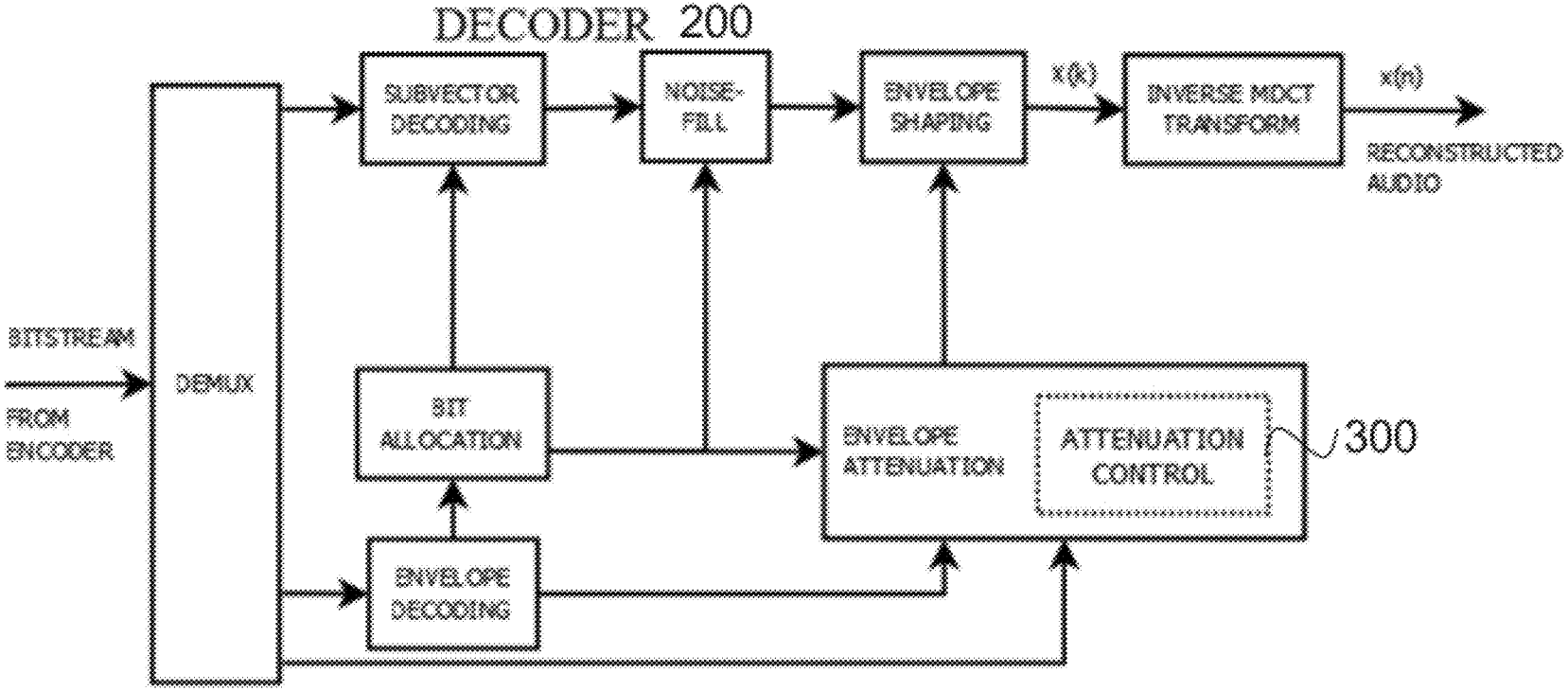
FIG. 6*b* illustrates an overview of a decoder containing an attenuation control according to an embodiment which is done based on a parameter from the bitstream which corresponds to an encoder analysis.

In a further embodiment, the decoder of an audio communication/compression system can implement the adaptive attenuation algorithm according to embodiments without explicitly accounting for regions that are noise-filled, bandwidth extended, or quantized with low number bits. Instead, regions candidate for attenuation can be selected based on an encoder side subvector analysis using a distance measure between the reconstructed subvector and the input subvector. The distance measure may also be calculated between the reconstruction and synthesis of the residual subvectors. A schematic overview of an encoder performing such analysis using a subvector analysis unit is illustrated in FIG. 6*a*. If the error in certain frequency region is above a certain threshold, the region is potential candidate for attenuation. The error measure can be for instance minimum mean squared error of the synthesized spectrum relative to the input spectrum, the energy error or a combination of error criteria. Such analysis can be used for identifying the regions for attenuation and/or deciding the attenuation for the identified regions. The encoder side analysis requires additional parameters to be added to the bitstream in order to reproduce the region identification and attenuation in the decoder. The decoder in such an embodiment would receive a result of the encoder side analysis via an encoded parameter through the bitstream and include the parameter in the attenuation control. Such a decoder is depicted in FIG. 6*b*.

Figure 7A:
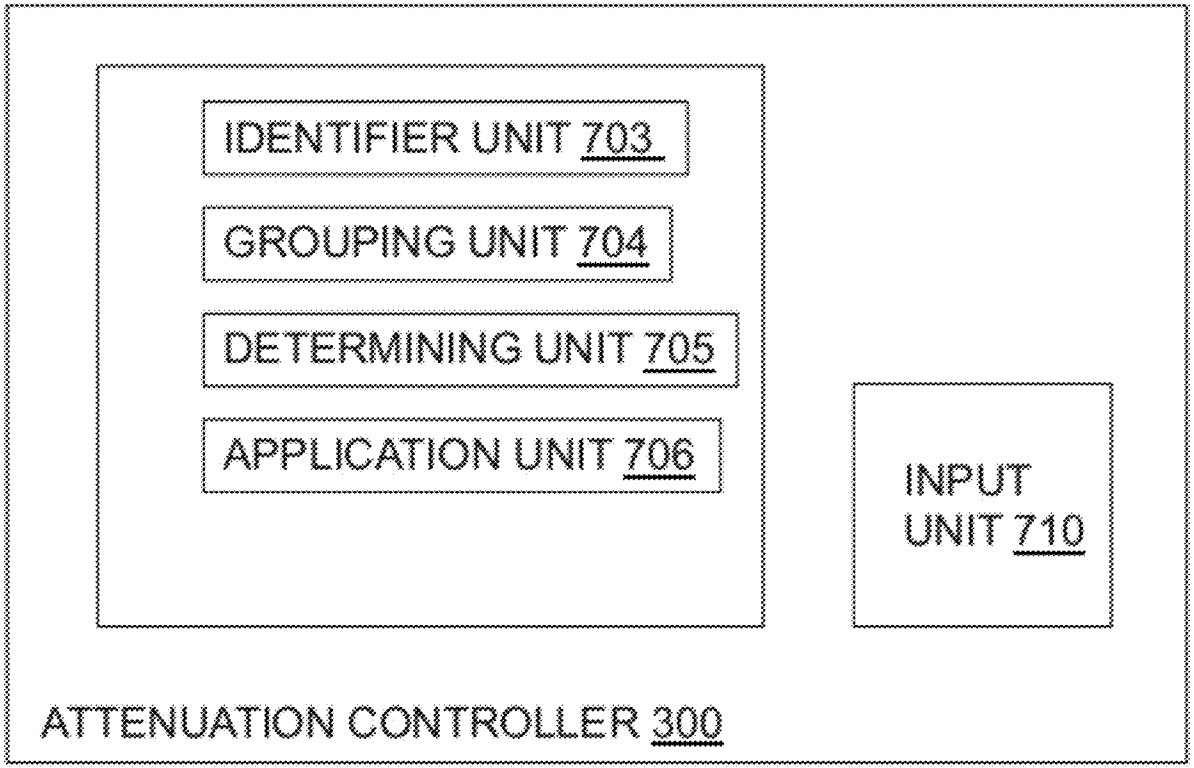
FIG. 7*a* and FIG. 7*b* illustrate schematically an attenuation controller according to embodiments of the present invention.

The attenuation controller which can be implemented in a decoder of e.g. a user equipment as shown in FIG. 7*a* comprises according, to one embodiment an identifier unit 703 configured to identify spectral regions to be attenuated, a grouping unit 704 configured to group subsequent identified spectral regions to form a continuous spectral region, and a determination unit 705 configured to determine a width of the continuous spectral region. Moreover, an application unit 706 configured to apply an attenuation of the continuous spectral region adaptive to the width is provided in the attenuation controller 300. In this way an increased width decreases the attenuation of the continuous spectral region.

According, to one embodiment, the spectral regions to be attenuated are coded with either a low number of bits or with no bits assigned. In addition, the identifier unit 703 configured to identify spectral regions that are coded with either a low number of bits or no bits assigned may further be configured to examine reconstructed subvectors to identify the spectral regions of the decoded frequency domain residual that are represented with low precision.

A spectral region may be said to be represented with low precision when the assigned number of bits for the said reconstructed subvector is below a predetermined threshold.

Alternatively, a pulse coding scheme is employed to encode the spectral subvectors and a spectral region is said to be represented with low precision if it consists of one or more consecutive subvectors where the number of pulses P(b) is below a predetermined threshold.

According to a further embodiment, spectral regions that are coded with no bits assigned are identified and or spectral regions that are coded with a low number of bits are identified.

The reconstructed spectrum can also include a region which is reconstructed using a bandwidth extension algorithm.

According to a yet further embodiment, the attenuation controller 300 comprises an input/output unit 710 configured to receive an analysis from the encoder and wherein the identifier unit 703 is further configured to identify the spectral regions to be attenuated based on the received analysis. In the received analysis a distance measure between a reconstructed synthesis signal and an input target signal are used by the encoder. If the distance measure in certain frequency region is above a certain threshold, the spectral region is a potential candidate for attenuation.

Figure 7B:
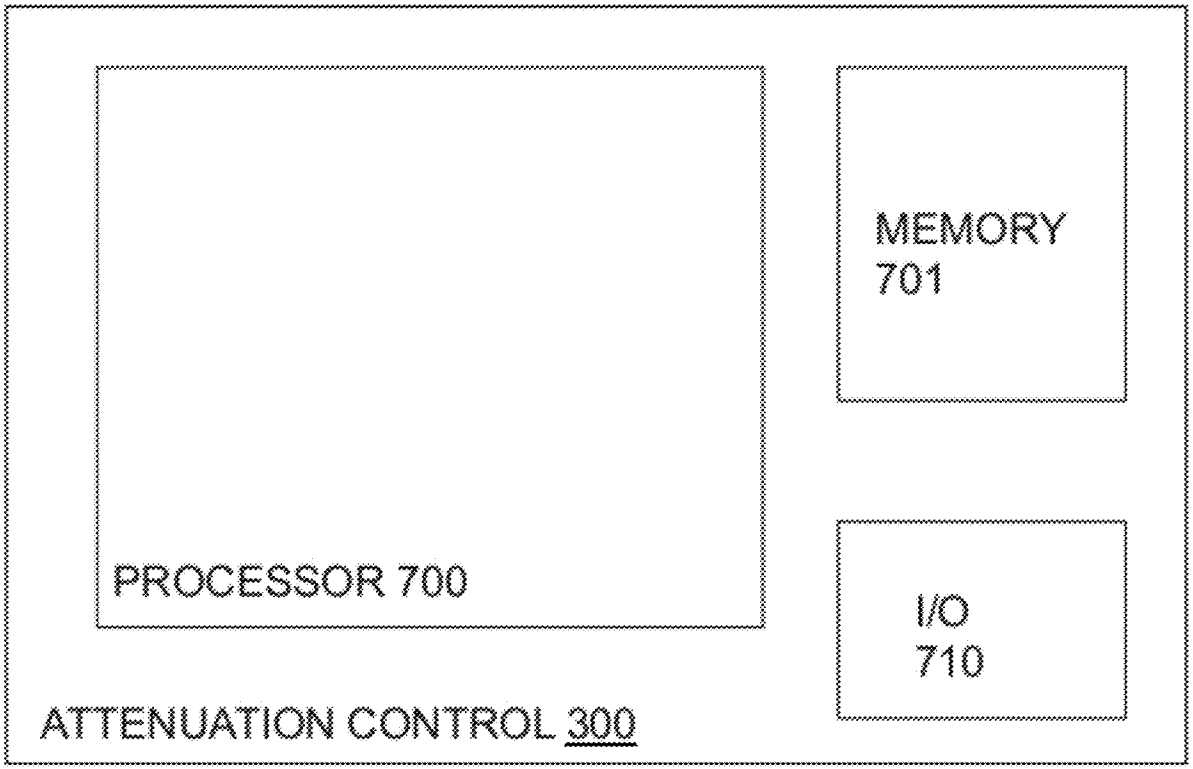

It should be noted that the units of the attenuation controller 300 of the decoder can be implemented by a processor 700 configured to process software portions providing the functionality of the units as illustrated in FIG. 7*b*. The software portions are stored in a memory 701 and retrieved from the memory when being processed. The attenuation controller. The input/output unit 710 is configured to receive input parameters from e.g. bit allocation and envelope decoding and to send information to envelope shaping.

Figure 8:
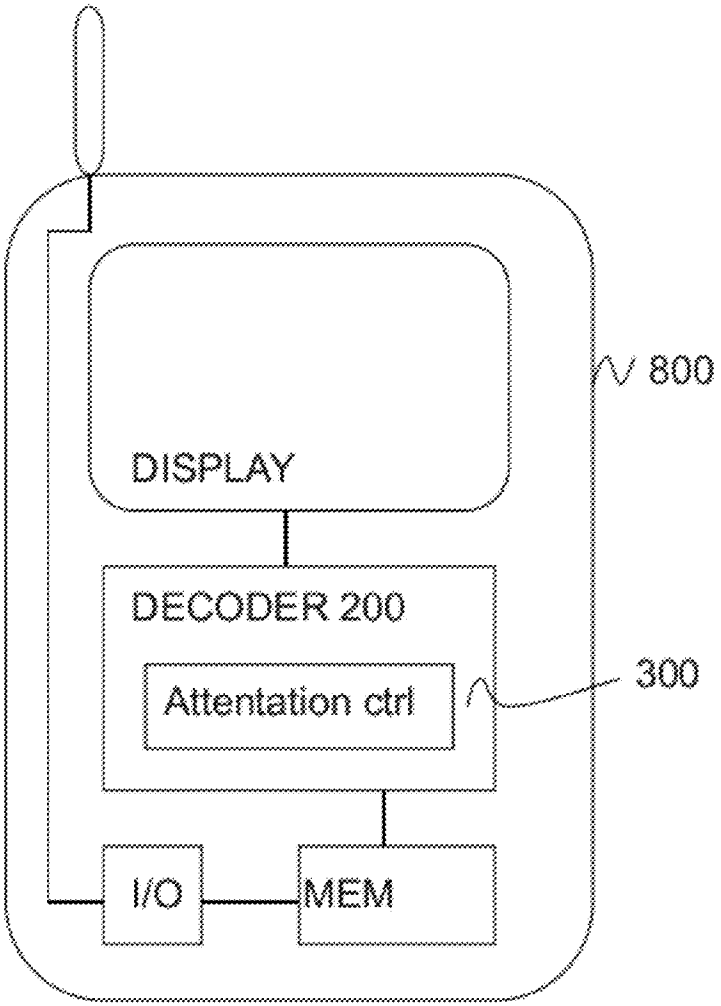
FIG. 8 illustrates a mobile terminal with the attenuation controller of embodiments of the present invention.
Figure 9:
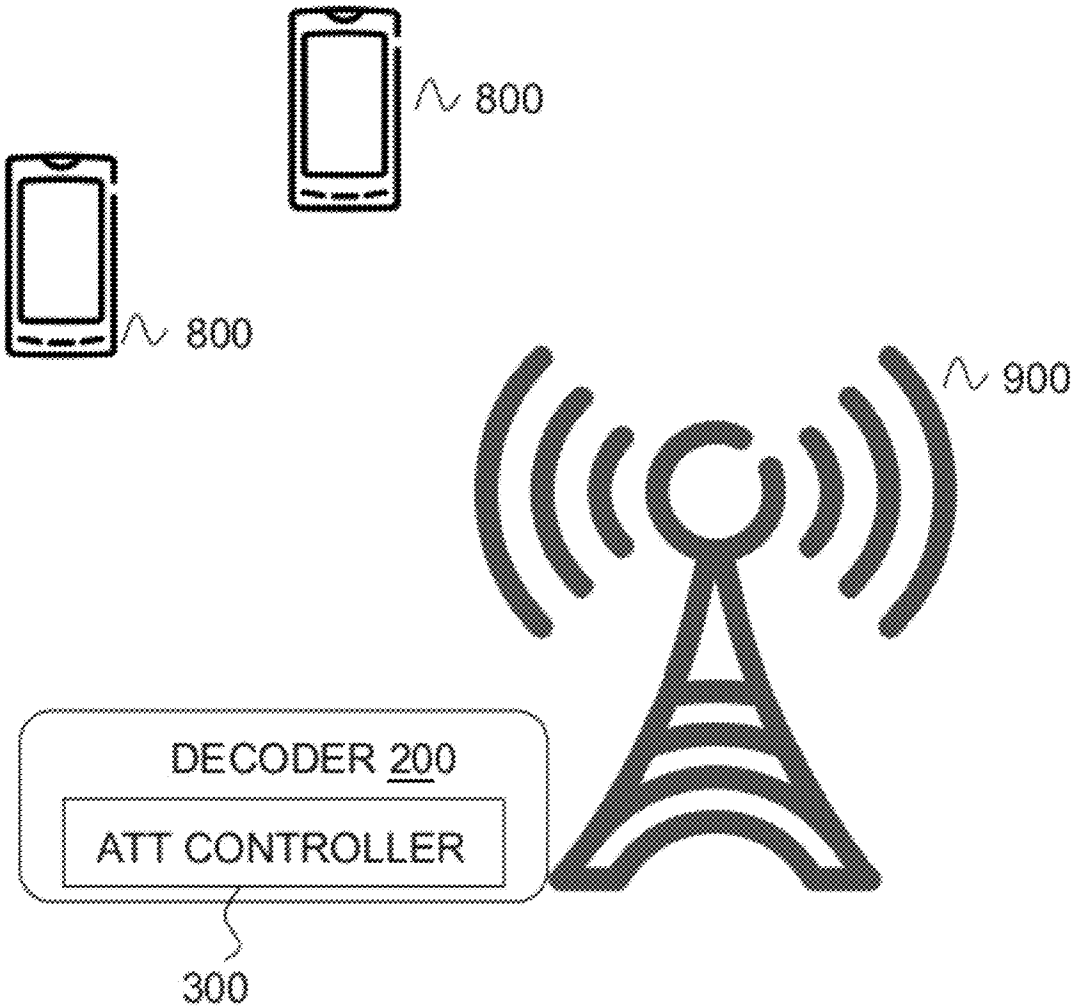
FIG. 9 illustrates a network node with the attenuation controller of embodiments of the present invention.

According to a further aspect of the present invention, a mobile device 800 comprising the attenuation controller 300 in a decoder according to the embodiments is provided as illustrated in FIG. 8. It should be noted that the attenuation controller 300 of the embodiments also can be implemented in a network node in a decoder as illustrated in FIG. 9.

The invention claimed is:

1. A method for a decoder for determining an attenuation to be applied to an audio signal, the method comprising:

identifying spectral regions of the audio signal to be attenuated;

grouping subsequent identified spectral regions to form a continuous spectral region;

determining a width of the continuous spectral region; and applying an attenuation of the continuous spectral region adaptive to the width such that an increased width decreases the attenuation of the continuous spectral region.

2. The method according to claim 1 wherein identifying spectral regions to be attenuated comprises identifying the spectral regions coded with either a low number of bits or with no bits assigned.

3. The method according to claim 2 wherein identifying spectral regions to be attenuated comprises examining reconstructed subvectors to identify the spectral regions to be attenuated.

4. The method according to claim 2 wherein examining the reconstructed subvectors comprises examining the number of bits assigned to the reconstructed subvectors to determine whether the number of assigned bits falls below a predetermined threshold; and wherein a spectral region has low precision when the number of bits assigned to the corresponding reconstructed subvector falls below the predetermined threshold.

5. The method according to claim 3 further comprising encoding the subvectors with a pulse coding scheme; wherein the corresponding spectral region has low precision when comprising one or more consecutive subvectors where the number of pulses P(b) falls below a predetermined threshold.

6. The method according to claim 1 wherein identifying spectral regions to be attenuated comprises identifying the spectral regions coded with no bits assigned.

7. The method according to claim 1 wherein identifying spectral regions to be attenuated comprises identifying the spectral regions coded with a low number of bits.

8. The method according to claim 1 where the continuous spectral region further includes a region reconstructed using a bandwidth extension algorithm.

9. The method according to claim 1 wherein identifying spectral regions to be attenuated comprises identifying the spectral regions to be attenuated based on an analysis received from an encoder: wherein the analysis identifies potential candidate spectral regions for attenuation based on whether a distance measure between a reconstructed synthesis signal and an input target signal in a frequency region is above a threshold.

10. An attenuation controller of a decoder for determining an attenuation to be applied to an audio signal, the attenuation controller comprising:

an identifier unit configured to identify spectral regions to be attenuated;

a grouping unit configured to group subsequent identified spectral regions to form a continuous spectral region;

a determination unit configured to determine a width of the continuous spectral region; and an application unit configured to apply an attenuation of the continuous spectral region adaptive to the width such that an increased width decreases the attenuation of the continuous spectral region.

11. The attenuation controller according to claim 10 wherein the identifier unit identifies the spectral regions to be attenuated by identifying the spectral regions coded with either a low number of bits or with no bits assigned.

12. The attenuation controller according to claim 11 wherein the identifier unit is further configured to examine reconstructed subvectors.

13. The attenuation controller according to claim 12 wherein a spectral region has low precision when the number of bits assigned to the corresponding reconstructed subvector falls below a predetermined threshold.

14. The attenuation controller according to claim 12 wherein a pulse coding scheme is employed to encode the subvectors; and wherein the corresponding spectral region has low precision when comprising one or more consecutive subvectors where the number of pulses P(b) falls below a predetermined threshold.

15. The attenuation controller according to claim 10 wherein the identifier unit is configured to identify the spectral regions coded with no bits assigned.

16. The attenuation controller according to claim 10 wherein the identifier unit is configured to identify the spectral regions coded with a low number of bits.

17. The attenuation controller according to claim 10 where the continuous spectral region further includes a region reconstructed using a bandwidth extension algorithm.

18. The attenuation controller according to claim 10:

further comprising an input unit configured to receive an analysis from an encoder;

wherein the identifier unit is further configured to identify the spectral regions to be attenuated based on the received analysis; and wherein the analysis identifies potential candidate spectral regions for attenuation based on whether a distance measure between a reconstructed synthesis signal and an input target signal in frequency region is above a threshold.

19. A mobile terminal comprising:

an attenuation controller of a decoder for determining an attenuation to be applied to an audio signal, wherein the attenuation controller comprises:

an identifier unit configured to identify spectral regions to be attenuated;

a grouping unit configured to group subsequent identified spectral regions to form a continuous spectral region;

a determination unit configured to determine a width of the continuous spectral region; and an application unit configured to apply an attenuation of the continuous spectral region adaptive to the width such that an increased width decreases the attenuation of the continuous spectral region.

20. A network node comprising:

an attenuation controller of a decoder for determining an attenuation to be applied to an audio signal, wherein the attenuation controller comprises:

an identifier unit configured to identify spectral regions to be attenuated;

a grouping unit configured to group subsequent identified spectral regions to form a continuous spectral region;

a determination unit configured to determine a width of the continuous spectral region; and an application unit configured to apply an attenuation of the continuous spectral region adaptive to the width such that an increased width decreases the attenuation of the continuous spectral region.

* * * * *

UNITED STATES PATENT AND TRADEMARK OFFICE

CERTIFICATE OF CORRECTION

PATENT NO. : 8,706,509 B2
APPLICATION NO. : 13/379054
DATED : April 22, 2014
INVENTOR(S) : Näslund et al.

It is certified that error appears in the above-identified patent and that said Letters Patent is hereby corrected as shown below:

In the Specification

In Column 1, Line 43, delete “sufficient” and insert -- insufficient --, therefor.

In Column 3, Line 1, delete “1.6” and insert -- 16 --, therefor.

In Column 3, Line 56, delete “(FTC)” and insert -- (FPC) --, therefor.

In Column 3, Line 63, delete “105” and insert -- 105. --, therefor.

In Column 5, Line 2, delete “spectral,” and insert -- spectral --, therefor.

In Column 7, Line 50, delete “according,” and insert -- according --, therefor.

In Column 7, Line 60, delete “According,” and insert -- According --, therefor.

In Column 8, Line 10, delete “and or” and insert -- and/or --, therefor.

In the Claims

In Column 8, Line 60, in Claim 4, delete “claim 2” and insert -- claim 3 --, therefor.

Signed and Sealed this
Ninth Day of September, 2014

Michelle K. Lee

Michelle K. Lee
*Deputy Director of the United States Patent and Trademark Office*